United States Patent [19]

Clavel et al.

[11] 4,156,576

[45] May 29, 1979

[54] PNEUMATICALLY CONTROLLED TAMPER

[76] Inventors: Alain Clavel, 3, Rue des Mobiles; Bernard R. Helliot, 20, Rue Masséna, both of Lyon (Rhône), France

[21] Appl. No.: 793,241

[22] Filed: May 3, 1977

[30] Foreign Application Priority Data

May 7, 1976 [FR] France ..... 76 14351

[51] Int. Cl.[2] ..... E01C 19/34

[52] U.S. Cl. ..... 404/133; 91/234; 173/139

[58] Field of Search ..... 404/133; 173/139, 113; 91/234

[56] References Cited

U.S. PATENT DOCUMENTS

| | | | |
|---|---|---|---|
| 1,147,660 | 7/1915 | Vaughan | 91/234 X |
| 2,004,083 | 6/1935 | Scott | 404/133 |
| 2,861,548 | 11/1958 | Burgess | 91/234 X |
| 2,951,427 | 9/1960 | Moir | 404/133 X |
| 3,028,841 | 4/1962 | Leavell | 404/133 X |
| 3,232,188 | 2/1966 | Frohnauer | 404/133 X |
| 3,372,759 | 3/1968 | Uebel | 404/133 X |
| 3,601,009 | 8/1971 | Burgess | 91/234 |
| 3,635,133 | 1/1972 | Stougaard | 404/133 |
| 3,736,843 | 6/1973 | Leibundgut | 91/234 |
| 3,857,448 | 12/1974 | Lines | 404/133 X |

*Primary Examiner*—Nile C. Byers, Jr.
*Attorney, Agent, or Firm*—Browdy & Neimark

[57] ABSTRACT

A pneumatically controlled tamper includes a cylinder which has a lateral supply opening for compressed air and which is integral with a foot. A piston with a symmetrical structure possesses two internal channels provided with check valves. The first channel terminates at one end on the lateral surface of the piston, above its median plane, and at the other end at the bottom of the piston in a lower chamber connected to the atmosphere by an escape opening. The second channel terminates at one end on the lateral surface of the piston, below its median plane, and at the other end at the top of the piston, in an upper chamber connected to the atmosphere through another escape opening. When the piston is on the bottom of the cylinder, the supply opening supplies the first channel, this arrangement making it possible to initiate a reciprocating movement which is maintained without any distribution system. The invention is used preferentially for soil compacting.

5 Claims, 9 Drawing Figures

PNEUMATICALLY CONTROLLED TAMPER

FIELD OF THE INVENTION

The present invention relates to a tamper, classified under the technical category of compressed air soil-compacting equipment.

BACKGROUND OF THE INVENTION

In the present state of the art, three classes of tampers are used for compacting the bottoms of trenches or locations at which accessibility to vibrating plates or rollers is difficult.

The first class includes those tampers which are driven by a gasoline or diesel engine, including a rod and crank system which, by means of springs, drives a weight which is connected to a foot which strikes the ground and tamps it.

The second class includes those tampers comprising a piston sliding in a cylinder, as well as a system for injecting fuel oil, acting as a diesel engine. The design of these machines is analogous to that of the free-piston generator of Pescara, but in this case the energy supplied by the combustion of the fuel oil serves to drive the body of the machine toward the ground to compact it.

The third class of tampers includes those driven by compressed air, and including a rotary valve which ensures the distribution of the air as a function of the position of the piston in the body of the tamper, the control of the piston valve being accomplished by the sliding of fingers, connected to the valve, in helical grooves cut in the piston.

The latter machines, operating on a principle described in French Patent No. 1,396,104 in the name of one of the present inventors, as well as the previous tampers with diesel engines, have a common feature, a heavy piston which weighs approximately one-third of the weight of the machine, i.e., 15 to 50 kg.

In view of the considerable weight of this piston, it will be understood that any system which makes it possible to cause it to move in a reciprocating manner within its cylinder will likewise cause a reciprocating movement of the cylinder, in accordance with the law of action and reaction, with the compressed air or gas always simultaneously bearing against the surface of the piston and the bottom of the cylinder which it faces.

This pneumatic connection can exist for both faces of the piston, or for only one face, if the other end of the piston is elastically linked to the other end of the cylinder by means of a spring or a plurality of springs.

Since the weight-spring systems have the feature, valuable in this context, of entering into resonance if they are excited at their natural frequency, this makes it possible in the case of tampers to manufacture machines which jump higher. They are separate from the pneumatic system which is the object of the present invention.

Since it is possible to use the springs on one side of the piston, with compressed air control acting on the other side, this system is not desirable as it produces disorderly movements in the tampers which are equipped with it. The vibration which ensures compacting has superimposed upon it a slow vibration whose frequency is several cycles per minute.

At the nodes of this second vibration, the foot of the tamper jumps only slightly and at the troughs it jumps too high, thereby presenting a danger to the feet or legs of the operator controlling it, operation of the machine therefore being more or less uncontrollable.

Furthermore, such a system always introduces a source of fragility inherent in the presence of springs whose vibrations are not controlled. When the foot strikes a hard object, the shock wave is propagated from the foot into the spring wire, causing the latter to vibrate at a high frequency and with an intensity which can be disastrous.

Therefore, all tampers or other similar devices such as rams, listed above, are complex, and accordingly, costly and fragile. The juxtaposition of these two characteristics results in an increased purchase price, and especially a consumption of spare parts, and therefore prohibitive maintenance costs, resulting in a definite disaffection on the part of contractors for this class of equipment.

SUMMARY OF THE INVENTION

The object of the present invention is to allow the construction of sturdy tampers, not costly to manufacture and maintain, and not comprising fragile mechanisms such as internal combustion engines, springs, rollers, rod and crank systems, cams, piston rings, etc., so as to be reliable.

For this purpose, a further object of the present invention is a tamper which comprises, within a cylinder with an essentially vertical axis, provided with at least one compressed-air intake opening located half way up, and integral with a foot or other tool rigidly connected to its lower part, a piston with a symmetrical structure possessing a first internal channel terminating at one end on the lateral surface of the piston, above its median plane orthogonal to its axis, and at the other end at the bottom of the piston, in a lower chamber of the cylinder, communicating with the atmosphere through at least one first escape opening, a check valve being provided in this first channel, and a second internal channel terminating at one end on the lateral surface of the piston, below its median plane orthogonal to its axis, and at the other end at the top of the piston, in an upper chamber of the cylinder communicating with the atmosphere through at least one second escape opening, a check valve being provided in this second channel, the arrangement being such that when the piston rests on the lower face of the cylinder, the supply opening for the latter will be at the same level as the lateral terminus of the first piston channel.

This internal arrangement makes it possible to produce a reciprocating movement by the piston within the cylinder, and consequently a vibration of the compacting foot, by supplying the cylinder with compressed air in a continuous fashion, but without an air-distribution system, as a function of the position of the piston in the cylinder, the rather complicated functioning cycle being explained hereinafter.

The two check valves allow the piston to be braked by pneumatic action when it approaches its upper or lower dead point, thus preventing said piston from striking one of the ends of the cylinder violently. In one especially simple embodiment, these two check valves are constituted by a ball located at the end of each channel in the upper or lower chamber, respectively, the travel of such ball being limited by a pin or similar other element.

Advantageously, the supply of compressed air to the tamper is controlled by a valve, which, in the closed position, stops the operation of the tamper and connects the supply opening of the cylinder with the atmosphere. This arrangement allows acceleration of the return of the piston to its lower position, where it must be in order to allow operation of the tamper to resume.

BRIEF DESCRIPTION OF THE DRAWINGS

In any event, the present invention will be better understood from the description which follows, with reference to the schematic drawing attached, which shows as nonlimiting examples several embodiments of this tamper.

DETAILED DESCRIPTION OF PREFERRED EMBODIMENTS

Figure 1:
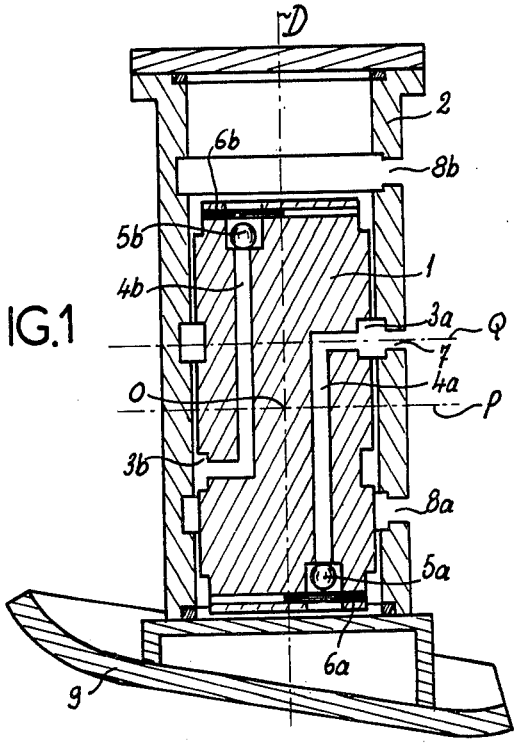
FIG. 1 is a vertical cross section through a first embodiment of the tamper according to the invention.

The tamper according to the present invention consists essentially of a motor system which causes a vibrating movement of piston 1 and cylinder 2, whose design is shown in FIG. 1.

Piston 1 is provided with two peripheral openings 3*a* and 3*b*, symmetrical relative to its median plane P orthogonal to the axis D common to piston 1 and cylinder 2. Upper opening 3*a* communicates through a channel 4*a* with the lower chamber delimited by piston 1 and the bottom of cylinder 2. At the point where channel 4*a* terminates in this chamber, a check valve is provided which in the example in question comprises a simple ball 5*a* whose travel is limited by a means, such as a pin 6*a*, said valve allowing the air to escape through channel 4*a* only in the downward direction. Likewise, piston 1 being entirely symmetrical relative to its central point 0 located at the intersection of plane P and axis D, lower opening 3*b* communicates through a channel 4*b* with the upper chamber delimited by piston 1 and the top of cylinder 2. At the point where channel 4*b* terminates in this chamber, a check valve is provided which likewise comprises a ball 5*b* whose travel is limited by pin 6*b*, said valve allowing air to escape only in the upward direction.

Cylinder 2 likewise has a structure which is symmetrical relative to its median plane Q. It is provided with an opening 7 for supplying compressed air, located in this median plane Q, and two symmetrical escape openings 8*a* and 8*b*. Opening 8*a* causes the lower chamber of cylinder 2 to communicate with the atmosphere, and opening 8*b* allows the upper chamber of cylinder 2 to communicate with the atmosphere. Each of these openings has been shown in the form of a single hole in FIG. 1, which is only a schematic diagram, but in practice a plurality of radical holes may be provided, said holes being pierced essentially at the same level and terminating at the bottom of a single internal recess, cut in cylinder 2. Beneath cylinder 1 is mounted foot 9 of the tamper, and in the embodiment shown in FIGS. 2 and 3, the motor system of the tamper is also connected to a manual control system consisting particularly of a handle 10. It is appropriate to equip the device with an effective suspension, capable of properly filtering the considerable vibrations of cylinder 2, so that the latter will be transmitted to the ground through foot 9 but not to the operator, so as to avoid the injuries caused by these vibrations.

For this purpose, the tamper, in the example shown, is provided with a housing 11 intended to reduce the noise of the escaping compressed air, screwed on cylinder 2, and two uprights 12, framing housing 11. At their upper ends, uprights 12 support a hinge 13 around which a control arm 14 is mounted in a pivoting manner, essentially perpendicular to uprights 12. This arrangement prevents the transmission of vibrations parallel to axis D of piston 1 and of cylinder 2 to the operator, and it likewise permits him to raise handle 10 and arm 14 in order to clear a bend in the trench or any other obstacle better.

Handle 10 is elastically articulated on shaft 15 mounted on the end of arm 14, for the purpose of filtering the vibrations perpendicular to uprights 12, i.e., oriented in the direction of the axis of arm 14; the elastic joint in question must be sufficiently flexible to attenuate high-frequency vibrations (foot 9 strikes the ground at the rate of approximately 800 blows per minute), while remaining sufficiently rigid to allow the pressure from the operator to be transmitted in order to allow easy control of the tamper.

Figure 2:
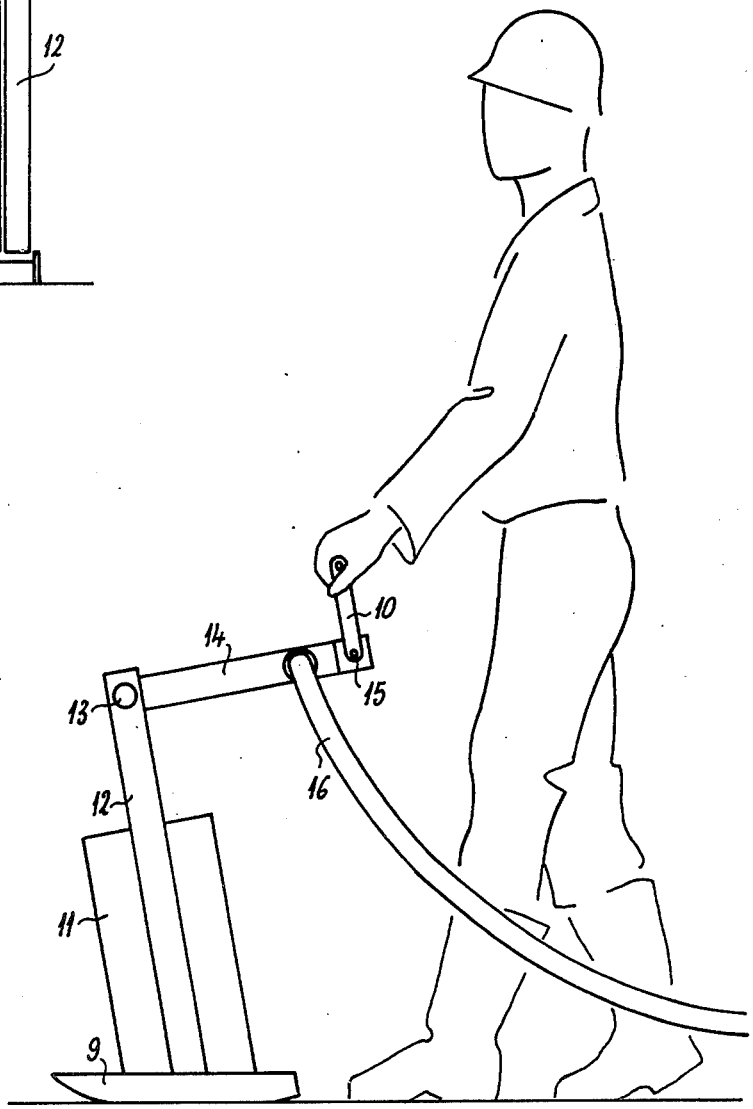
FIG. 2 is a side view of this tamper, provided with a manual control system.

Finally, the compressed air is supplied through a supply hose 16 which can be seen in FIG. 2, said hose being connected to control arm 14 by a device which allows it to pivot relative to the hose and the arm, so as to permit a free orientation of this hose when the operator raises or lowers arm 14. The air then passes into this arm, then through uprights 12 made in the form of hollow tubes, through joint 13, fabricated in a sealed manner. Cylinder 2 is supplied through two openings 7 located diametrally opposite one another, each being opposite one of uprights 12.

The rotating connection which permits the link between hose 16 and arm 14 can be combined with a slide valve system, not shown, which allows control of the starting and stopping of the tamper.

Figure 4:
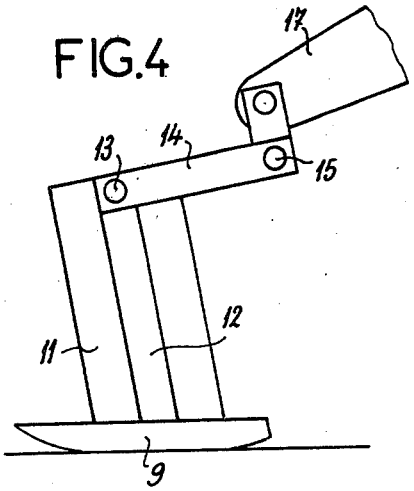
FIG. 4 is a side view showing a similar tamper mounted on the end of a shovel arm.

The above description relates to a manually controlled light tamper, but it can easily be used to make a similar tamper, or larger size and weight, mounted at the end of an arm 17 of a shovel or another adapted piece of construction equipment, as shown in FIG. 4. In the example shown, this tamper is connected to arm 17 by a suspension similar to that described previously, but of larger dimensions, whose elements are numbered in the drawing using the same reference numerals, in order to protect the arm of the machine from vibrations.

Figure 6:
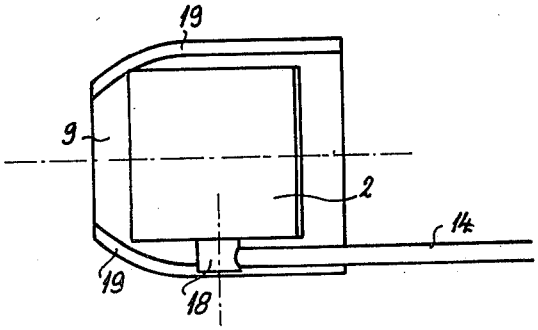
FIGS. 5 and 6 are end and plan views from above, respectively, showing another embodiment of this tamper.
Figure 5:
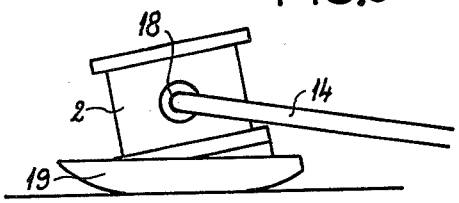

Likewise, a slightly different version of this tamper can be made to obtain a lighter and more rapid device, whose operation is similar to that of a plate vibrator, shown in FIGS. 5 and 6.

The internal construction of this tamper conforms to that shown in FIG. 1, but the vertical dimensions of cylinder 2 are reduced, so that the piston is lighter and the frequency of the vibrational movement is greater. Moreover, the low height of the device allows compacting the bottoms of trenches, passing beneath any pipes that may be present.

Figure 3:
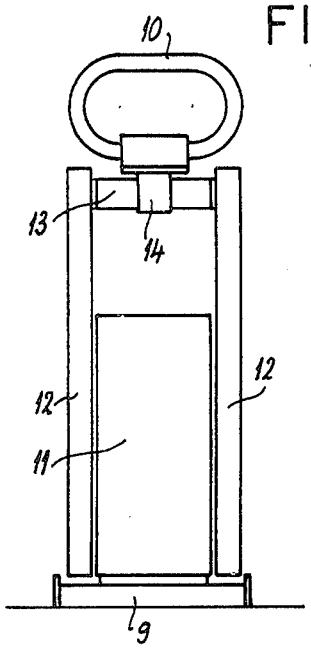
FIG. 3 is an end view of the device shown in FIG. 2.

The improved suspension described hereinabove with reference to FIGS. 2 to 4 is eliminated, and supply hose 16 terminates at a rotary connection 18 mounted directly on cylinder 2. Thus, hose 16 can be oriented alternately forward or backward relative to the device, depending on the direction in which the latter is traveling relative to the source of compressed air. As shown more particularly in FIG. 6, the plate vibrator, constituting the equivalent of foot 9, is framed by lateral feet 19 which allow said vibrator to guide itself along the trench, the operator intervening primarily to cause the tamper to execute a half turn at the end of its travel.

Figure 7:
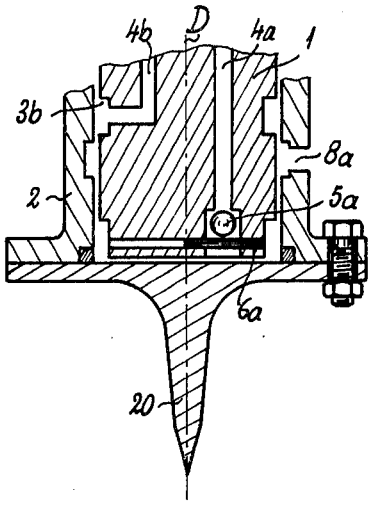
FIGS. 7, 8, and 9 are vertical cross sections similar to FIG. 1, representing in part three other embodiments of the invention.
Figure 8:
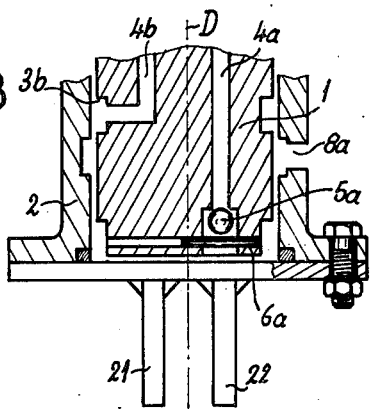
Figure 9:
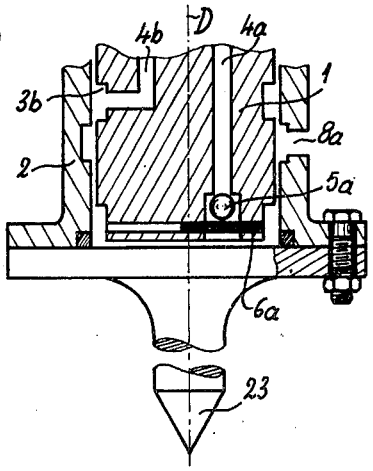

These specific applications of the tamper described herein constitute only nonlimiting examples and the field of application of the device can also be extended by replacing foot 9 by other tools which allow other kinds of work to be done, always being rigidly connected to cylinder 2, as shown in FIGS. 7, 8, and 9.

In these versions, the pneumatic system, constituting the heart of the apparatus and represented only in partial fashion, remains identical to that shown in FIG. 1. FIG. 7 shows an embodiment in which the tool mounted under the motor device consists of a type of spade 20 intended for breaking pavement. In the version shown in FIG. 8, this tool is replaced by a driver made of two vertical plates 21 and 22, welded to the plate at the bottom end of cylinder 2, and used to drive sheet piles. Finally, FIG. 9 relates to another embodiment in which the tool consists of a moil 23 of the concrete- or rock-breaking type, the device being used in this case for demolition work.

In all cases, the operation of the pneumatic motor device is as follows:

Before the device is started, piston 1 is left resting on the bottom of cylinder 2 under the influence of gravity, this corresponding to the position shown in FIG. 1 in question here. When the operator opens the supply valve, some compressed air comes in through inlet 7, enters the upper opening 3*a* of the piston 1 which, in this initial position, is at the level of orifice 7, and passes through channel 4*a* into the lower chamber of cylinder 2.

The upper chamber then being connected to the atmosphere through escape opening 8*b*, piston 1, whose cross section is considerable, is raised violently, sliding along cylinder 2 under the force of the compressed air admitted to the lower chamber. After piston 1 travels a certain upward distance, the supply of compressed air through opening 7 and opening 3*a* is cut off, said opening 3*a* no longer being opposite the supply opening 7, and the air expands in the lower chamber as piston 1 rises.

Simultaneously, upper escape opening 8*b* is covered by the top of piston 1 and the pressure of the air increases in the upper chamber, which no longer communicates with the open air. The upper check valve 5*b* closes under the influence of this pressure.

Under the influence of the forces of pressure and inertia, piston 1 continues its upward movement and reaches a position in which it uncovers lower escape opening 8*a*, so that the lower chamber is connected to the atmosphere. Simultaneously, lower opening 3*b* of the piston arrives opposite supply opening 7.

The upper chamber of cylinder 2 is then supplied with compressed air through channel 4*b* and through check valve 5*b*, which opens under the influence of the air supply. The air pressure increases in the upper chamber and it can exceed the supply pressure because of the compression exerted by the movement of the piston, valve 5*b* then closing. Thus, a pneumatic brake is produced which prevents piston 1 from striking the upper surface of cylinder 2.

The configuration of piston 1, as well as that of cylinder 2 being symmetrical, the operation described above for the upward movement of piston 1 is repeated in the same fashion for the downward movement, and the cycle is repeated indefinitely until the supply of compressed air through opening 7 is interrupted. It should be noted that the action of the pneumatic brake, described above at the end of the upward movement, is especially advantageous during the downward movement of piston 1, in order to prevent it from striking the lower end of cylinder 2, even in the case when the piston undergoes considerable acceleration, which takes place when the foot strikes a hard obstacle.

The vibration of piston 1, as a result of the law of action and reaction, causes vibration of cylinder 2, which is rigidly linked to foot 9 of the tamper, thus producing the desired compacting of the soil.

The operator cuts off the supply to the pneumatic motor system to stop the operation of the device, by actuating the valve (not shown) mentioned above. This valve advantageously comprises a slide disposed so as to connect supply opening 7 with the atmosphere; this ensures the escape of the air which may still be imprisoned in cylinder 2, so as to accelerate the return of piston 1 to its lower position, and thus to permit the rapid restarting of the tamper.

As is clearly evident, as can be seen from the above, the invention is not limited to only those embodiments of the tamper which have been described above as examples; on the contrary, it embraces all varieties of the design which comprise equivalent means, particularly regardless of their applications.

What is claimed is:

1. A vibrating tool with pneumatic control, comprising:

a cylinder, having a substantially vertical axis, provided with two compressed-air supply openings, located at mid-height and diametrically opposite one another;

tool means, for impacting a work surface, fixedly connected to said cylinder;

a piston, disposed within said cylinder, provided with a first internal channel terminating at one end on the lateral surface of said piston orthogonal to the vertical axis thereof and above the median plane thereof at a level such that said lateral opening is at the same level as the supply opening in said cylinder when said piston rests at the lower end of said cylinder, and terminating at the other end at the base of said piston, and a second internal channel terminating at one end on the lateral surface of said piston below the median plane thereof orthogonal to the vertical axis thereof and terminating at the other end at the top of said piston;

a first check valve disposed within said first channel for permitting air to flow downwardly only;

a second check valve disposed within said second channel for permitting air to flow upwardly only; and elastic suspension means connected to said cylinder for substantially insulating the operator or means holding the vibrating tool from the vibration thereof, said suspension means including two hollow uprights connected at opposite sides of said cylinder at said supply openings, said hollow uprights serving as supply ducts;

wherein said cylinder has a first escape opening at the upper portion thereof which connects the interior of said cylinder to the atmosphere when said piston is at the lowermost position thereof and a second escape opening at the lower portion thereof which connects the interior of said cylinder to the atmosphere when said piston is at the uppermost position thereof.

2. A vibrating tool in accordance with claim 1, wherein the lateral termination points of said first and second channels are at the base of peripheral recesses in said piston, said recesses being symmetrical with respect to the median plane of said piston orthogonal to the longitudinal axis thereof.

3. A vibrating tool in accordance with claim 1, wherein each of said first and second check valves comprises a ball located at the end of said channel terminating at the end of said piston, and a pin or similar element limiting the travel of said ball.

4. A vibrating tool in accordance with claim 1, further including a valve means for stopping the tamper by connecting the supply opening of said cylinder with the atmosphere when said valve means is in the closed position and for allowing the passage of compressed air to the supply opening of said cylinder when in the open position.

5. A vibrating tool in accordance with claim 1, wherein said tool means is a tamping foot.

* * * * *